US006111207A

United States Patent [19]

Arterberry et al.

[11] Patent Number: 6,111,207

[45] Date of Patent: Aug. 29, 2000

[54] KIT FOR MULTI-CONFIGURABLE CONTROL PANEL DESIGN FOR OFFICE EQUIPMENT

[75] Inventors: John H. Arterberry; Dan Scott Caputo, both of San Diego, Calif.; Paul M. O'Brien, Veradale, Wash.

[73] Assignee: Hewlett-Packard Company, Palo Alto, Calif.

[21] Appl. No.: 09/345,198

[22] Filed: Jun. 30, 1999

[51] Int. Cl.[7] ..... H01H 13/70

[52] U.S. Cl. ..... 200/5 R; 200/5 A; 29/622

[58] Field of Search ..... 29/622; 200/5 R, 200/5 A, 18, 293, 295, 296, 307, 310, 312, 317, 329, 333, 341, 345; 206/223, 576; 361/679, 680, 683, 686, 728–733; 400/472, 473, 486, 489

[56] References Cited

U.S. PATENT DOCUMENTS

| | | | |
|---|---|---|---|
| 4,066,850 | 1/1978 | Heys, Jr. | 200/5 A |
| 4,078,257 | 3/1978 | Bagley | 364/900 |
| 4,092,527 | 5/1978 | Luecke | 364/709 |
| 4,119,839 | 10/1978 | Beckmann et al. | 235/145 R |
| 4,158,130 | 6/1979 | Speraw et al. | 235/146 |
| 4,773,090 | 9/1988 | Goatman | 379/429 |
| 5,624,194 | 4/1997 | Matsuzawa | 400/477 |
| 5,798,715 | 9/1998 | Saperstone | 346/22 |

*Primary Examiner*—Michael Friedhofer

[57] ABSTRACT

A multi-configurable office machine, which includes a control panel subassembly having a plurality of user-activated key-switches for controlling functions of the office machine. A first control panel cover is adapted for installation on the control panel subassembly, the first cover comprising a first cover structure providing user access to a first set of the key-switches when the first cover is installed on the control panel subassembly. A second control panel cover is adapted for installation on the control panel subassembly, the second cover comprising a second cover structure providing user access to a second set of the key-switches when the second cover is installed on the control panel subassembly. By installing a selected one of the panel covers, different groups of the key-switches are accessible to the user, thereby configuring the machine to a first configuration or a second configuration.

15 Claims, 4 Drawing Sheets

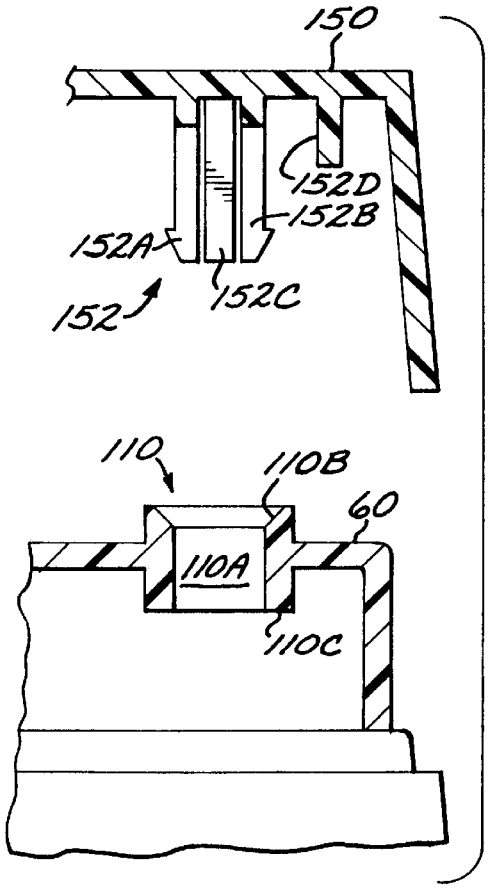
FIG.2
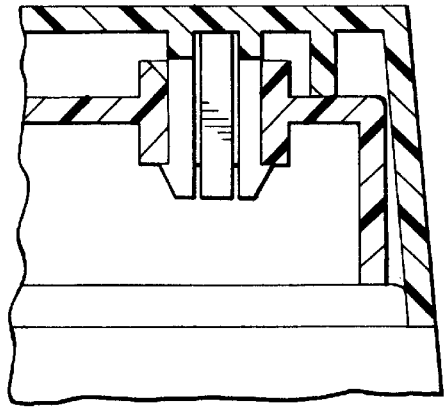
FIG.3
FIG.4
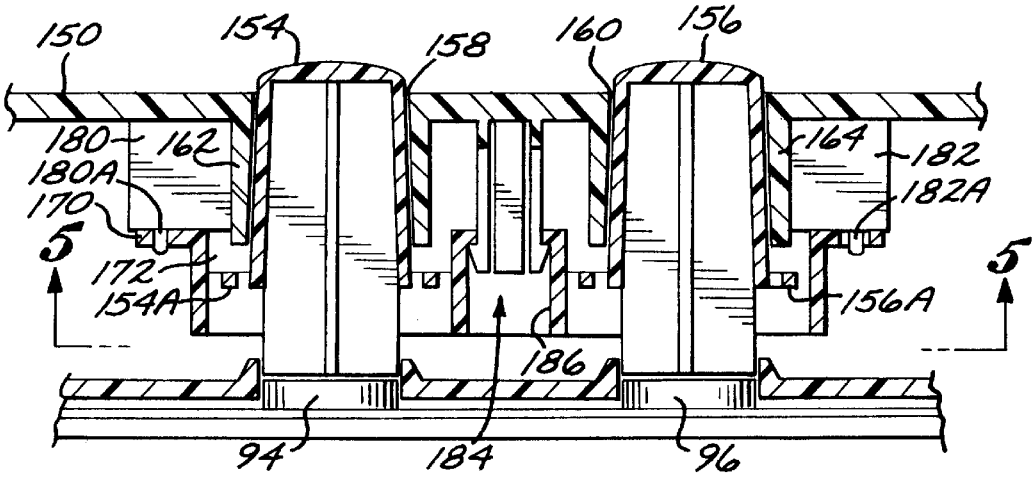

KIT FOR MULTI-CONFIGURABLE CONTROL PANEL DESIGN FOR OFFICE EQUIPMENT

TECHNICAL FIELD OF THE INVENTION

This invention relates to office equipment, and more particularly to a technique for configuring a universally configurable piece of office equipment to a particular product configuration wherein certain features or performance capabilities are added or disabled, by providing a particular control panel cover for each product configuration and a universal control panel assembly.

BACKGROUND OF THE INVENTION

Office equipment such as printers, scanners, copiers and facsimile machines are in common use. Recently, new types of office equipment have been introduced, which combine functions of various machines into a single piece of equipment. These multi-purpose machines include, for example, the "OfficeJet" series of machines marketed by Hewlett-Packard Company, which includes functions of a printer and a facsimile machine, and as well those functions of a scanner and a copier. This invention will be described in the exemplary context of such multi-purpose machines, although the invention is not limited in application to such machines.

Manufacturers of office machines for today's globalized marketplace will typically manufacture one machine for many different countries. The product is then localized for a given country or language requirement. Localization refers to the process of having the product text messages in the local language into which the product is to be sold and ultimately used. Typically the product is built with any messages to be displayed on a product display stored in memory in the various languages. During the localization process, the machine is set up to use the particular language for displayed messages, and to provide the messages in the appropriate language for any text messages appearing on the machine housing including control panels. Thus, for example, the control panel may have a "Start" keycap which needs to be labeled in the appropriate language. A label is placed on the control panel in the appropriate language during the localization process. This of course is time consuming and adds to the cost of production, and would cause a need for a different control panel for each language. Another technique is to provide a snap-on cover for the control panel of the machine, the cover having the requisite language text already included on the cover.

Manufacturers of office machines, such as the multi-purpose equipment, can construct a particular type of machine to have a range of performance and operational features or options, i.e. a universal machine, which can be configured as different product models. Configuration refers to the adaptation of the product to add or remove performance and/or features from the universal machine to meet customer needs. In the past, the factory typically made certain quantities of the product having the various options; i.e. the configuration was done at the factory. This has the disadvantage of added inventory for the various product configurations, and added cost in product manufacture, since different product configurations are built, as compared to building only a single universal machine.

SUMMARY OF THE INVENTION

A method is described for late point configuration of a multi-configurable office machine, comprising the following steps:

providing the multi-configurable office machine having a control panel with a plurality of user-activated key-switches for controlling functions of the office machine;

providing a plurality of types of covers for assembly to the control panel, wherein a first cover type provides user access to a first set of the key-switches when the cover is installed on the control panel, and a second cover type provides user access to a second set of the key-switches when the cover is installed on the control panel;

selecting one of the plurality of types of covers for configuring the machine to a configuration type having functions provided by the corresponding set of key-switches; and installing a cover of the selected type on the control panel to configure the machine to the configuration type.

In accordance with a further aspect, the control panel further has one or more indicator light sources for providing one or more indicator functions. The first cover type further includes an opaque structure have one or more regions transparent to light emitted from corresponding light sources. The second cover type includes an opaque structure for blocking light from one or more of the light sources when installed on the control panel.

In accordance with another aspect of the invention, a multi-configurable office machine is described, which includes a control panel subassembly having a plurality of user-activated key-switches for controlling functions of the office machine. A first control panel cover is adapted for installation on the control panel subassembly, the first cover comprising a first cover structure providing user access to a first set of the key-switches when the first cover is installed on the control panel subassembly. A second control panel cover is adapted for installation on the control panel subassembly, the second cover comprising a second cover structure providing user access to a second set of the key-switches when the second cover is installed on the control panel subassembly. Thus, by installing a selected one of the panel covers, different groups of the key-switches are accessible to the user, thereby configuring the machine to a first configuration or a second configuration.

BRIEF DESCRIPTION OF THE DRAWING

These and other features and advantages of the present invention will become more apparent from the following detailed description of an exemplary embodiment thereof, as illustrated in the accompanying drawings, in which:

FIG. 2 is a cross-sectional exploded view of a portion of the control panel cover and the control panel subassembly, taken along line 2—2 of FIG. 1.

FIG. 3 is a cross-sectional view of the portion of the control panel cover and the control panel subassembly of FIG. 2, showing the elements snap-fitted into assembled position.

FIG. 4 is a cross-sectional view taken along line 4—4 of FIG. 1.

DETAILED DESCRIPTION OF THE PREFERRED EMBODIMENT

An exemplary embodiment of the invention is described with reference to configuring a multi-purpose office machine, which includes a control panel subassembly and a control panel cover which snap fits onto the subassembly. The control panel subassembly includes various key-switch controls and light indicators. The key-switch controls allow the user to control various functions of the machine, and input commands and data. The light indicators convey information to the user, such as status of various functions and warning/error indications. The configuration process typically requires that a second product configured from the generic product and with a lesser number of features have less access to key-switch controls and light indicators than a first product with a greater number of features. In the past, the solution was for the factory to make certain quantities of product having the various options, i.e. the configuration was done in the factory, and this required having a different control panel assembly for each type of product.

In accordance with the invention, the generic or universal machine is constructed with a generic control panel subassembly, which has all the keycaps and light-pipe circuitry and electronics needed for all configurations of all products. Configuration is achieved by installing a custom control panel cover for a particular configuration onto the generic control panel assembly. If a particular key-switch or light-pipe is not needed for a particular configuration, then the custom cover does not provide a keycap for the key-switch or light-pipe for the light source, but instead covers it over. By having keycaps and light-pipes snap into the custom cover, or alternatively into the generic control panel subassembly, late point configuration is made possible. Also, by having one generic control panel assembly which is used on multiple products, production volume for the generic panel assembly is increased, and cost is therefore reduced. At the same time, the need to design control panel subassemblies for the various product options is eliminated. Moreover, configuration can be accomplished after factory assembly of the machine, e.g. after shipment to a distribution center location, a retail establishment, or even by the user.

Figure 1:
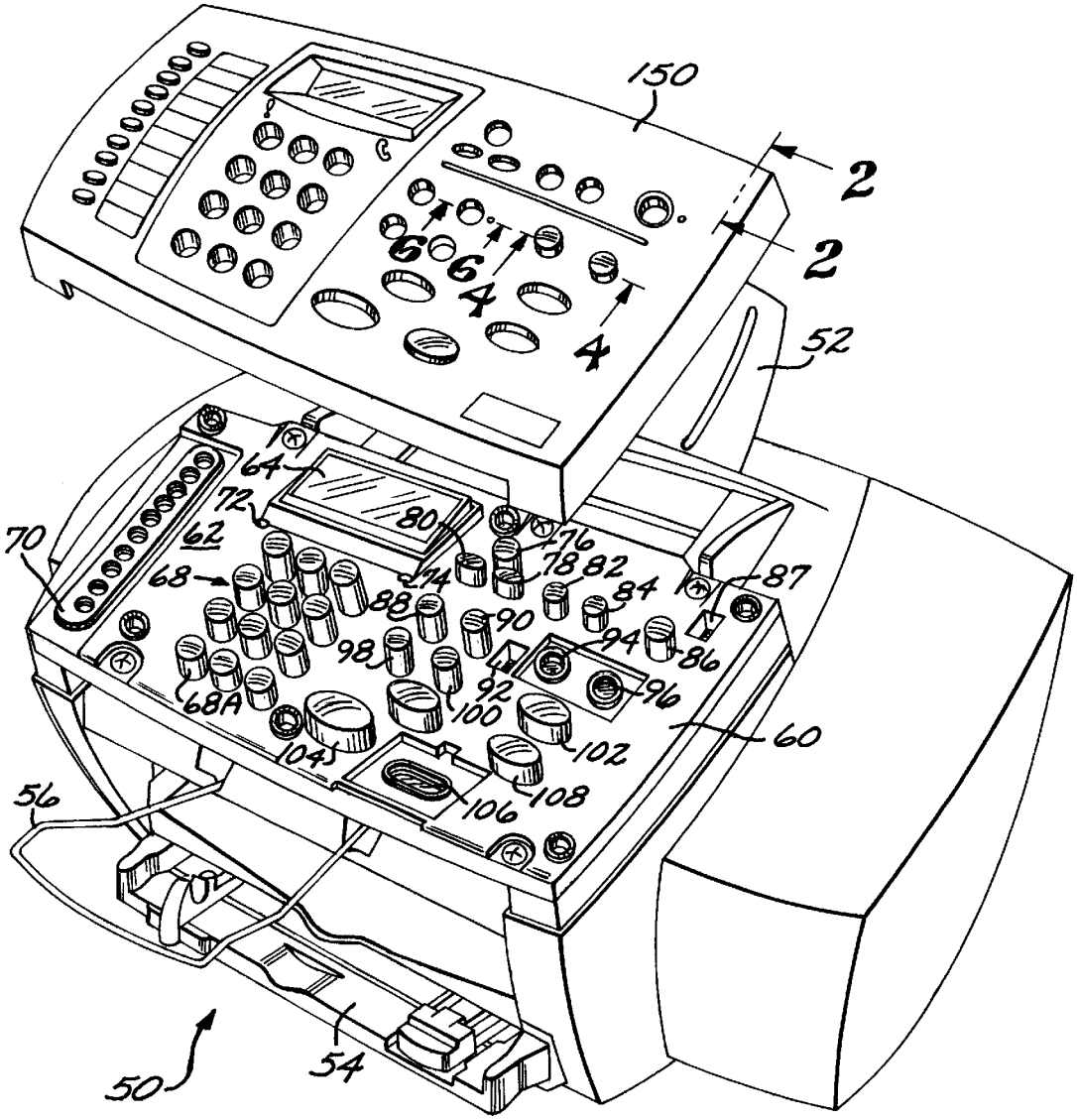
FIG. 1 is an isometric view of a multi-purpose office machine embodying the invention, showing a first control panel cover in exploded view relative to the control panel subassembly.

FIG. 1 is an isometric view of an exemplary multi-function office machine 50 embodying this invention. This machine in a generic platform provides scanning, printing, copying and faxing functions. A document feed guide 52 is provided at the top rear side of the machine, for feeding documents to be scanned or faxed. An input paper/media tray 54 is provided at the lower front side of the machine. An output tray is provided by pull-out wire loop 56, to receive output from the machine. The functions of the machine are controlled by the control panel subassembly 60 which includes a circuit board (not visible in FIG. 1) which carries machine controllers such as a microprocessor, memory and the like. The control panel subassembly 60 includes a top housing structure 62 which cooperates with the circuit board to provide structural support and protection for the various key-switches, display and light indicators which are electrically and mechanically coupled to the circuit board. Thus, for example, the subassembly 60 includes an LCD panel 64 which displays information to the user. Keycap array 68 includes exemplary keycap 68A and is a telephone-type keypad allowing the user to enter information and to dial telephone numbers for the faxing function. The functions of the other key-switches/keycaps and indicator lights are as follows, for this exemplary embodiment.

70 Speed Dialing, One-touch key-switches
72 Indicator light—warning/error light
74 Indicator light—Telephone line hookup
76 Menu function keycaps
78 Right keycap
80 Left keycap
82 Enter
84 Lighter/darker
86 Power keycap (on/off)
87 Indicator light—power on
88 Speed Dial (facsimile function)
90 Auto answer (facsimile function)
92 Indicator light—auto answer active
94 Copy quality (photocopy function)
96 Reduce/enlarge (photocopy function)
98 Redial/pause (facsimile function)
100 Color resolution (facsimile function)
102 Color copy (photocopy function)
104 Start
106 Scan
108 Black copy The machine 50 further includes a control panel cover 150 for assembly to the control panel 60. The control panel cover 150 snap fits onto the control panel, as illustrated in FIGS. 2 and 3. Here, one edge fastener 152 of the cover 150 is shown, which is received in a corresponding receptor 110 of the control panel 60. The fastener includes four barbed tabs arranged concentrically about a center axis, including tabs 152A, 152B and 152C, formed integrally with the cover 150, e.g. from injection molded plastic. The diameter of the fastener 152 is slightly larger than the opening 110A, which is defined by chamfered walls 110B. As the cover is pushed onto the control panel, the fastener 152 comes into contact with the chamfered wall, and the barbed ends of the tabs (e.g. tabs 152A–152C) are compressed, bending inwardly, allowing insertion of the fastener into the opening 110A. The underside of the chamfered wall 110B forms a shoulder 110C against which the barbed ends expand and abut against, as shown in FIG. 3, holding the cover in place. A protruding tab 152D controls the depth of insertion of the fastener 152 into the receptor 110, and its length cooperates with the length of the tabs 152A, 152B to securely hold the cover in place. Seven of the fasteners 152 are employed in this embodiment, at the corners and other locations of the cover, and engage with corresponding receptors in the control panel assembly 60.

In accordance with an aspect of the invention, different panel covers are provided to configure the machine 50 to different configurations.

In this exemplary embodiment, the user-activated functions are selected by activation of membrane switches comprising the control panel subassembly 60. Of course, the invention is not limited to use of membrane switches as a make-break circuitry, and other circuitry could alternatively be employed. The user-activated make-break circuits are referred to herein as "key-switches." In this exemplary embodiment, the user actuates the key-switches through keycaps, the keycaps being pressed by the user to apply force to the underlying membrane key-switch on the control panel subassembly.

It is noted that some of the keycaps reside with the control panel assembly 60 and protrude above the surface of the structure 62 by a sufficient distance to extend through corresponding openings formed in the panel cover 150, to be accessible for manual activation by the machine user. Examples of this type of keycap include the keycap 68A, the power keycap 86 and the start keycap 104. Other keycaps reside with the cover. Examples of this type include the one touch speed dial keycaps comprising array 200 (FIG. 8) which contact the key-switch array 70, the copy quality reduce/enlarge keycap 156 (FIG. 8) which contacts key-switch 96, and the scan keycap 202 (FIG. 8) which contacts key-switch 106. Alternatively, for a different control panel embodiment, keycaps for a selected group or set of the key-switches can be omitted from the panel cover, so that the corresponding key-switches on the subassembly 60 are not accessible to the machine user with the panel cover in place.

Figure 5:
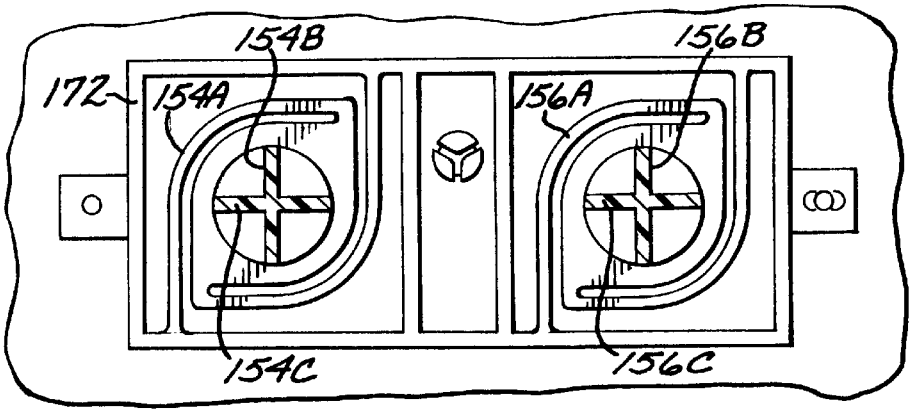
FIG. 5 is a bottom view of a portion of the structure illustrated in FIG. 4.

FIGS. 4 and 5 illustrate one exemplary technique for holding keycaps in the panel cover 150 to provide a cover-mounted means to actuate the membrane key-switch on the control panel subassembly 60. FIG. 4 shows the two key-switches 94 and 96 mounted in the control panel 60. Corresponding keycaps 154, 156 are supported by the cover 150 for movement to engage the key-switches 94, 96. While movement is permitted to engage the key-switches, the keycaps are constrained by mounting structures from becoming disassembled from the cover. The keycaps 154, 156 protrude through respective openings 158, 160 in the cover 150, with side walls 162, 164 defining the openings. In this exemplary embodiment, the side walls 162, 164 have a slight taper, as do the keycaps 154, 156. Integrally formed with the keycaps into a keycap array 170 are living hinges 154A, 156A, which extend between the keycaps and a frame portion 172 of the structure 170. The array 170 can be formed from a plastic material through injection molding processes. The keycaps 154, 156 are respectively formed of crossed ribs structures 154B, 154C and 156B, 156C (FIG. 5). The array 170 is aligned to the underside of the cover 150 by attachment pins 180A, 182A extending from bosses 180, 182, and by fastener 184 protruding from the undersurface of the cover and engaging receptacle 186 of the keycap array 170. The living hinges such as hinges 154A, 156A allow the keycaps to be depressed downwardly into engagement with the key-switches 94, 96.

Figure 6:
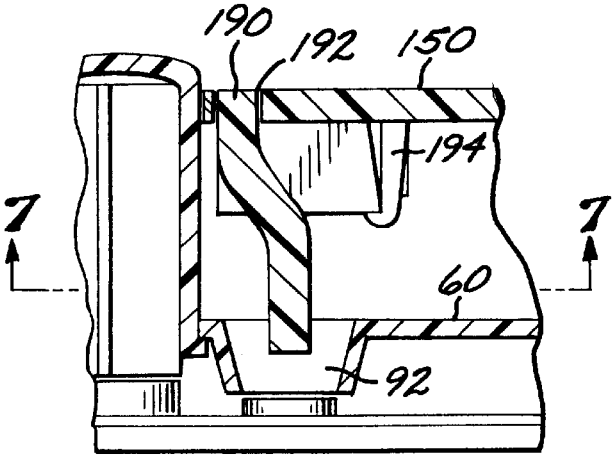
FIG. 6 is a cross-sectional view taken along line 6—6 of FIG. 1.
Figure 7:
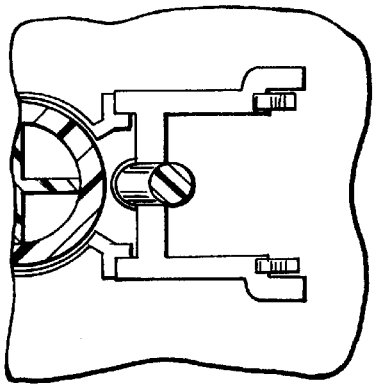
FIG. 7 is a bottom view of a portion of the structure illustrated in FIG. 6.

One or more of the indicator lights such as 72 or 87 are visible in the panel cover 150 through a corresponding opening. For an alternate panel cover for a different configuration, the cover opening for one or more of these indicator lights can be omitted, so that the indicator light is covered over and not visible to the machine user. FIGS. 6 and 7 illustrate a light pipe arrangement for conducting light emitted from a light source such as an LED mounted on the control panel through an opening formed in the cover. Here a light pipe structure 190 is attached to the cover by a barbed tab 194 protruding from the underside of the cover, and the light pipe has a tip extending into hole 192 formed in the cover. The indicator light 92 generates light energy which is passed into the light pipe and through the cover hole, and is visible to a user. The light pipe structure 190 can be fabricated of a transparent plastic material. The attachment of the light pipe structure 190 to the cover 150 is by a snap fit.

Figure 8:
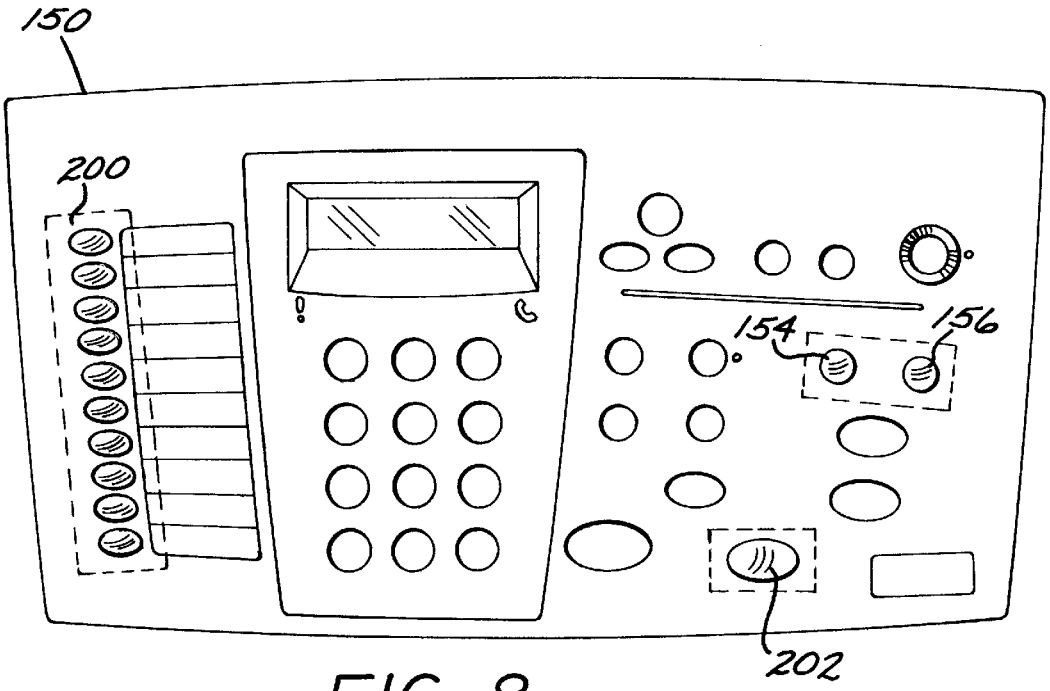
FIG. 8 is a top plan view of a first control panel cover for assembly to the control panel subassembly of the machine of FIG. 1.

FIG. 8 is a top plan view of the control panel cover 150 in the condition when it is not assembled to the machine 50. This particular cover is adapted for a first machine configuration, wherein all the key-switches and indicator lights on the control panel assembly are available to the user once the cover is attached to the control panel assembly. Thus, in this example, the cover carries a speed dial keycap array 200, which enables the user to actuate the speed dial key-switches 70 on the control panel assembly, as well as the keycaps 154, 156 described above, and keycap 202. The keycap 202 is for making contact with the key-switch 106 on the control panel subassembly. Thus, the cover 150 configures the machine 50 to a configuration in which a first set of user-accessible function key/switches and light indicators available on the control panel 60 are fully functional after assembling the cover onto the control panel assembly. In this example, the first set provides a configuration of full functionality of all user-accessible machine functions.

Figure 9:
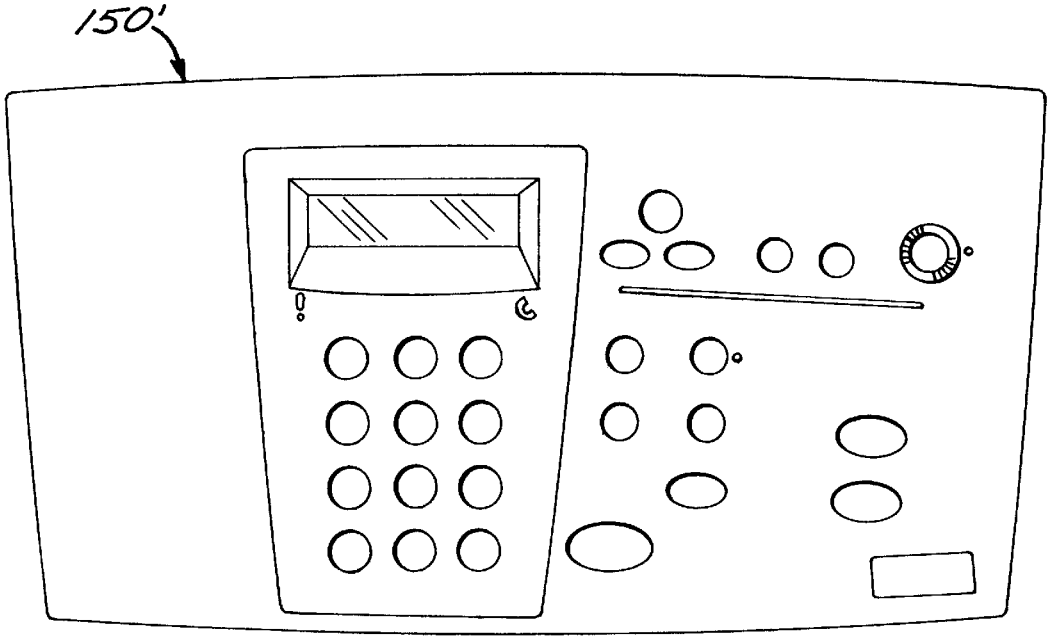
FIG. 9 is a top plan view of a second control panel cover for assembly to the control panel subassembly of the machine of FIG. 1.

FIG. 9 illustrates an exemplary second control panel cover 150' which is adapted for a second machine configuration. This cover is fabricated without the keycap array 200, and without corresponding openings formed in the cover. Similarly, the cover 150' is fabricated without openings for the keycaps 154, 156 and 202 of the cover 150. Further, the alternative cover can omit a light indicator function by not providing an opening through which light from an indicator light is passed to the user. For example, the second cover 150' can omit the light indicator opening for indicator light 92 as well as the light pipe structure 190 of the cover 150, so that light from light source 92 is not visible to the user once the cover is installed, even though the light source can be fully functional. Thus, the cover 150' configures the machine 50 to a second configuration wherein a second set of switches is available to the user, and the functions provided by key-switches 94, 96, 106, as well as speed dial key-switches 70 are not available to the user.

The foregoing first and second cover embodiments are exemplary as to the number and functions of the key, switch or indicator light functions which can be omitted from a particular configuration. In addition, particular embodiments can employ three or more different covers, all for assembly to a common control panel, for providing the capability of providing three or more different product configurations.

In an exemplary embodiment, the respective panel covers 150, 150' are fabricated of a thermoplastic material using an injection molding process. Of course, other fabrication techniques could alternatively be employed.

In some embodiments, the configuration process can be enhanced by some type of electronic part configuration, wherein the particular machine is programmed electronically to a particular configuration and certain functions are disabled from operation for a given configuration. This electronic configurability can disable certain function, e.g. disable from operation a switch function or an indicator light. In addition to such electronic configurability, a control panel cover selection will also be used in accordance with the invention to provide late point configuration of the generic machine.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A method for late point configuration of a multi-configurable office machine to one of a plurality of possible machine configuration types, comprising the following steps:

providing the multi-configurable office machine having a control panel with a plurality of user-activated key-switches for controlling functions of the office machine;

providing a plurality of types of covers for assembly to the control panel, wherein a first cover type of the types of covers provides user access to a first set of said key-switches when the first cover type is installed on the control panel, and a second cover type of the types of covers provides user access to a second set of said key-switches when the second cover type is installed on the control panel;

selecting only one of said plurality of types of covers for configuring the machine to a configuration type having functions provided by a corresponding set of said key-switches;

installing a cover of said selected type on said control panel to configure the machine to said configuration type; and supplying the machine of said configuration type for an end user of the machine.

2. The method of claim 1 wherein the control panel further has at least one selectively energizable indicator light source for providing at least one indicator function, said first cover type further includes an opaque structure having at least one region transparent to light emitted from said at least one light source, and said second cover type includes an opaque structure for blocking light from said at least one light source when installed on said control panel.

3. The method of claim 1 wherein the step of installing said cover of said selected type includes engaging a plurality of fasteners fabricated integrally with said cover with a corresponding plurality of fastener receptacles on said control panel.

4. The method of claim 1 wherein the step of providing the multi-configurable office machine includes:

assembling the office machine at a factory location, wherein fabrication of the office machine is essentially completed except for installation of said cover on said control panel; and shipping the assembled office machine from said factory location to a distribution location, and wherein the step of installing said cover includes installing the cover at said distribution location.

5. The method of claim 1 wherein the step of providing the multi-configurable office machine includes:

assembling the office machine at a factory location, wherein fabrication of the office machine is essentially completed except for installation of said cover on said control panel; and shipping the assembled office machine from said factory location to a retail establishment location, and wherein the step of installing said cover includes installing the cover at said retail establishment location.

6. The method of claim 1 wherein the step of providing a plurality of types of cover includes:

providing the first cover type having a first cover carrying at least one keycap, said at least one keycap for engaging a corresponding one of the key-switches on the control panel when installed on the control panel;

providing the second cover type without at least one keycap corresponding to said at least one keycap of said first cover type, wherein the corresponding key-switch on the control panel is not accessible to the user when installed on the control panel.

7. The method of claim 6, wherein the step of providing the first cover type includes having a corresponding at least one opening formed through the first cover type through which said at least one keycap carried by the first cover type protrudes, and the step of providing the second cover type includes providing the second cover type devoid of a corresponding at least one opening through the second cover.

8. A multi-configurable office machine, comprising:

a control panel subassembly having a plurality of user-activated key-switches for controlling functions of the office machine and at least one indicator light source for selective activation for providing at least one visual indicator function;

a first control panel cover for installation on the control panel subassembly, the first cover comprising a first cover structure providing user access to a first set of said key-switches when the first cover is installed on the control panel subassembly, said first cover comprising an opaque structure having at least one region transparent to light emitted from said at least one light source when installed on the control panel subassembly; and a second control panel cover for installation on the control panel subassembly, the second cover comprising a second cover structure providing user access to a second set of said key-switches when the second cover is installed on the control panel subassembly, said second cover structure comprising an opaque structure for blocking light from said at least one light source when installed on said control panel subassembly;

wherein a selected one of said first panel cover and said second panel cover configures the machine to a configuration type having functions provided by the corresponding first set or said second set of key-switches.

9. The machine of claim 8 wherein the first cover further includes at least one light pipe structure assembled to the first cover structure for guiding light from said at least one light source in the control panel subassembly to the first cover.

10. The machine of claim 8 wherein:

the control panel subassembly includes a first fastener structure;

the first cover includes a second fastener structure engageable with said first structure to install the first cover on the control panel subassembly;

the second cover includes a third fastener structure engageable with said first fastener structure to install the second cover on the control panel subassembly.

11. The machine of claim 10 wherein the first fastener structure comprises a plurality of fastener receptacles, said second fastener structure comprises a first plurality of fastener members protruding from an undersurface of the first cover structure, and said third fastener structure comprises a second plurality of fastener members protruding from an undersurface of the second cover structure.

12. The machine of claim 8 wherein the functions of the office machine includes facsimile machine functions, document scanning functions and document copying functions.

13. The machine of claim 8 wherein said key-switches comprise a set of membrane switches.

14. The machine of claim 8 wherein:

said first control panel cover includes at least one keycap carried by said first cover structure, said at least one keycap for engaging a corresponding one of said plurality of key-switches on the control panel when installed on the control panel;

said second control panel cover is devoid of at least one keycap corresponding to said at least one keycap of said first cover, wherein the said key-switch on the control panel is not accessible to the user when the second panel cover is installed on the control panel.

15. The machine of claim 14 wherein:

the control panel subassembly includes a plurality of keycaps mounted on the subassembly and protruding therefrom;

the first cover includes a first plurality of openings formed therein through which said plurality of keycaps mounted on the subassembly protrude when the first cover is installed thereon; and the second cover includes a second plurality of openings formed therein through which said plurality of keycaps mounted on the subassembly protrude when the second cover is installed thereon.

* * * * *